United States Patent [19]

Voisin et al.

[11] Patent Number: 4,773,133

[45] Date of Patent: Sep. 27, 1988

[54] METHOD AND DEVICE FOR RELAXING KNITTED FABRIC

[75] Inventors: Eugéne Voisin, Piney; Philippe Aujard, Bouilly, both of France

[73] Assignees: Institut Textile de France, Boulogne-Billancourt; Agence Nationale de Valorisation de la Recherche Anvar, Paris, both of France

[21] Appl. No.: 683,322

[22] Filed: Dec. 18, 1984

Related U.S. Application Data

[63] Continuation of Ser. No. 438,610, Nov. 2, 1982, abandoned.

[30] Foreign Application Priority Data

Nov. 4, 1981 [FR] France ..... 81 20690

[51] Int. Cl.[4] ..... D06C 7/00; D06C 17/00; D06B 13/00

[52] U.S. Cl. ..... 26/18.5; 26/21

[58] Field of Search ..... 26/18.5, 20, 21; 8/149.3, 152; 68/5 C

[56] References Cited

U.S. PATENT DOCUMENTS 2,661,520 12/1953 Hamilton et al. ..... 26/18.5
2,972,177 2/1961 Bidgood, Jr. ..... 26/1
3,594,914 7/1971 Kutsuki et al. .
4,007,517 2/1977 Turner et al. ..... 26/18.5

FOREIGN PATENT DOCUMENTS 1168076 8/1958 France .
2229798 12/1974 France .
920556 3/1963 United Kingdom ..... 26/20

*Primary Examiner*—Robert R. Mackey
*Attorney, Agent, or Firm*—Shenier & O'Connor

[57] ABSTRACT

The method for relaxing knitted fabrics according to the invention uses humidity, heat and agitation of the fabric. Said agitation is caused by projecting the fast-advancing fabric against a rigid support on which the then nontensioned fabric piles up.

The projection of the knitted fabric is obtained by driving said fabric by friction and without slipping, by means of a movable element of projection into the outlet zone from which the fabric is projected against a receiving zone of the support, which receiving zone is situated close to the outlet zone of the projecting element and substantially transversely to the direction of projection.

The movable element of projection is a movable belt turning over two cylinders of which one at least is a driving cylinder, whose driving speed can reach 600 meters/minute.

9 Claims, 2 Drawing Sheets

METHOD AND DEVICE FOR RELAXING KNITTED FABRIC

This is a continuation of co-pending application Ser. No. 438,610, filed on Nov. 2, 1982, now abandoned.

FIELD OF THE INVENTION

The present invention relates to a method for relaxing knitted fabrics and to a device for carrying out said method. The knitted fabrics referred to herein are fabrics produced with knitted machines, and can therefore be in tubular form in the case of circular knitting machines, or in flat form in the case of other machines, such as, for example, the rectilinear or Raschel knitting machine.

DESCRIPTION OF THE PRIOR ART

A knitted fabric, just off the knitting machine or after a post-treatment of bleaching, dyeing or finishing is quite remote from its normal balanced state, as far as dimensions are concerned, due to the stresses which it has been subjected to during the actual knitting or during the post-treatments. When such a fabric or articles made therewith are subjected to a wash, important shrinkages are noted, this being really unpleasant for the user.

A relaxing treatment is designed to bring the knitted fabric into a state which corresponds to a minimum of stresses; in this balanced state, which is suited to the stitch, the relaxed knitted fabric will theoretically be dimensionally stable. In fact, all the relaxing treatments tend towards this theoretical result, to keep the dimensional variations of the knitted fabric to a minimum.

A large number of equipment already exist for relaxing knitted fabrics. And in his U.S. Pat. No. 2,325,545 of Aug. 28, 1941, REDMAN had already emphasized the three factors which contribute to relaxing knitted fabrics, namely humidity, heat and agitation of the fabric. All the existing equipment is based on these factors while using different means.

The humidity can come from prior treatments, the knitted fabric being introduced in the relaxing equipment when still damp, for example, after an ordinary de-watering by mangle. The dampness can also be introduced directly during the relaxing process in the form of saturated steam or jets.

It is mostly a stream of hot air which brings the heat necessary to the relaxation.

The knitted fabric is vibrated either by mechanical means coming into contact with the fabric, or by vibrating the plate carrying the fabric at a high frequency, or else by intermittently sending air through nozzles onto the fabric. In this last case, the vibration and heat supply can be produced simultaneously by jets of hot air striking the fabric.

Most of the equipment currently used treat the knitted fabrics continuously; they are in fact dryers for which the relaxing function is complementary and not a priority. Consequently, in this equipment, the relaxing treatment is not sufficient for the knitted fabric to acquire a good dimensional stability, and it is especially insufficient to relax fabrics which are particularly difficult to relax such as flannel-type or looped knittings.

It is also known from U.S. Pat. No. 4,286,395 to use an apparatus for the surface treatment of textile products, wherein the treatment is conducted by wavingly floating the textile fabric inside a current of air flowing in reverse in a tubular treatment guide, against the walls of which the surface of the fabric is made to rub. This is, therefore, a surface treatment and not a relaxing treatment, since there is no real agitation shaking violently through the entire thickness of the fabric. In fact, the tests which have been conducted on this type of equipment have revealed its inadequacy to noticeably improve the dimensional stability of the knitted fabric.

SUMMARY OF THE INVENTION

It is the object of the present invention to overcome the disadvantages of the prior art, by proposing a method for relaxing knitted fabrics, which method uses, in combination, humidity, heat and agitation, the said agitation being caused by projecting the fast-speed advancing fabric, against a rigid support, said vibrations being followed by a piling up of said fabric on said support.

The speed required to obtain an agitating movement according to the invention is dependent on the characteristics of the installation and in particular on the distance separating the place from where the fabric is projected, from the place against which it is projected. The lower threshold of acceptable speeds, which in actual fact is related to the required quality standards, is easily determined experimentally; as will be shown in the examples given hereinafter, good results have been obtained with a driving speed of about 120 meters/minute.

The energy transmitted when projecting the knitted fabric onto the rigid support opposes the internal stresses of the fabric and enables the yarns constituting the stitches, and the stitches themselves to move one with respect to the other.

After projection against a rigid support, the knitted fabric is left untensioned, and piles up on the support : in this way, the yarns and stitches move progressively and the knitting approaches its balanced form. In order to reach this relaxed state, one treatment only according to the method of the invention is not sufficient; and once the yarns and stitches have been able to move freely due to the energy transmitted during the projection of the fabric onto the support, said fabric will undergo another identical treatment: projection of the fast-driven fabric onto a rigid support, followed by piling up of the untensioned fabric on said support, this being repeated as many times as is necessary to obtain the required result, i.e. to obtain a condition as close as possible to the relaxed form.

Advantageously, the knitted fabric is projected by being friction-driven by means of a movable projection element which, at the level of its outlet zone, projects the fabric violently against the receiving zone of the rigid support which is situated close to (preferably between 400 and 1000 millimeters) the outlet zone of the projecting element, and substantially transversally to the direction of projection.

It is also the object of the invention to propose a device especially designed for carrying out said method and which comprises a fast-moving movable element of projection, on which the knitted fabric moves, and a rigid element against which said fabric is projected and on which it piles up before being picked up on another device according to the invention.

Advantageously, the movable element is a conveyor belt. The knitted fabric is picked up from the surface of the rigid element where it has piled up, and it is conveyed at high speed by the conveyor belt and projected onto the rigid element situated close to the belt.

Advantageously, the rigid support pick-up zone is situated close to (preferably between 400 and 1000 millimeters) the inlet zone of the movable element of projection.

Advantageously, the rigid element is fixed and designed so that the knitted fabric, once projected, piles up into successive folds and slides over the surface of said element, before being driven by another movable element according to the invention.

Advantageously, the knitted fabric is in closed loop form. Because of this, the successive treatments required to bring the fabric to a relaxed form can be performed on a single device according to the invention. The looped fabric is then treated continuously: referring first to one portion of the knitted fabric, this is picked up from the rigid element where it has piled up, it is conveyed at high speed on the conveyor belt, projected against the part of the rigid element which is situated at the end of the conveyor belt and opposite thereof, whereupon it piles up untensioned into successive folds, and then slides over the rigid element, wherefrom it is picked up again and conveyed by the conveyor belt. Each portion of the knitted fabric is thus treated continuously; it suffices to this effect to design the device so that the transfer of the fabric by sliding over the rigid element be coordinated with the picking-up of the fabric by the conveyor belt.

A fact to be recalled is that the vibrating of the fabric according to the method of the invention should be associated to two other essential factors in order to obtain a good relaxation of the fabric within a reasonable time period, these factors being humidity and heat.

When the knitted fabrics have been subjected to a wet treatment, they have been de-watered by mangle beforehand and already contain the humidity necessary to the relaxation; in this case there is generally no need to add any more water. On the contrary, when the knitted fabric is dry, the humidity necessary to the relaxation will have to be introduced, for example, by the action of saturating steam.

The heat necessary to the relaxation is brought by any type of means capable of communicating to the fabric an adequate and uniform amount of heat energy. Generally speaking and in known manner, heat is brought in by the action of a current of hot air flowing around and through the fabric.

Advantageously, the action of that hot air continues until the fabric has reached a residual humidity rate situated around the regain of the material constituting it. The fabric so treated is not only in a relaxed form, it is also dry. It can be used without any subsequent drying for any other treatments which it will have to be subjected to.

The method according to the invention confers to the knitted fabric a dimensional stability which is improved compared with the known treatments, and it enables to treat successfully certain types of knitted fabrics on which the known treatments are not very efficient. This dimensional stability is very important for the operations to which the fabric will be subjected; it is often a condition of the satisfaction or dissatisfaction of the user of the article produced from the said fabric. If the dimensional stability of a fabric is not good, a tee-shirt made from said fabric will shrink after one or more washes: in certain cases, the shrinkage rate can be considerable, as much as 20%, which, conceivably, is most unpleasant for the user of the tee-shirt.

All the knitted fabrics treated with the method according to the invention have been found to have a dimensional stability which is compatible with the quality standards required by the consumers.

Another advantage brought by the method according to the invention is the increased bulkiness of the knitted fabric. For certain articles and in particular looped knittings, the bulky aspect of the article is a decisive factor of sale, volume being synonymous with comfort; moreover, more bulkiness can facilitate the subsequent treatments which the fabric will be subjected to, such as, for example, napping. An increased bulkiness is of course more obvious and therefore an advantage in fairly thick knittings such as raised nap knitting or looped knittings. Most knitted fabrics of this type which are treated with the method according to the invention have been found to have more bulkiness, as much as 50%, compared with an untreated knitted fabric, such as unsheared looped knitting.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1A:
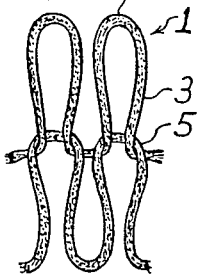
FIGS. 1A and 1B are respectively front and cross-sectional views of stitches of a knitting coming off the knitting machine.

A knitting fabric coming off a knitting machine presents stitches 1 which have suffered a number of stresses from the knitting operation; they are deformed with respect to the stitches 2 of the same knitting after a relaxing treatment. As can be seen when comparing FIGS. 1 and 2, the relaxing treatment entails a shortening of the wings 3 of the stitches, compensated by a widening of the heads 4 and of the feet 5 of said stitches. Moreover, in the relaxed knitting, the heads 4 of the stitches do not rest flat against the feet 5 of the next stitches, and the stitches overlap one another more, somewhat like the tiles of a roof. The cross-sectional views of the stitches illustrated in FIGS. 1 and 2 really show the difference in thickness between a knitting just off the knitting machine and a relaxed knitting; it is this difference which explains the increased bulkiness conferred by the relaxing treatment.

Figure 1B:
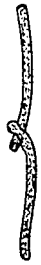
Figure 2A:
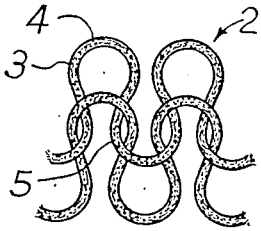
FIGS. 2A and 2B are respectively front and cross-sectional views showing the same stitches, after the knitting has undergone a relaxing treatment.
Figure 2B:
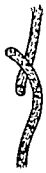
Figure 3:
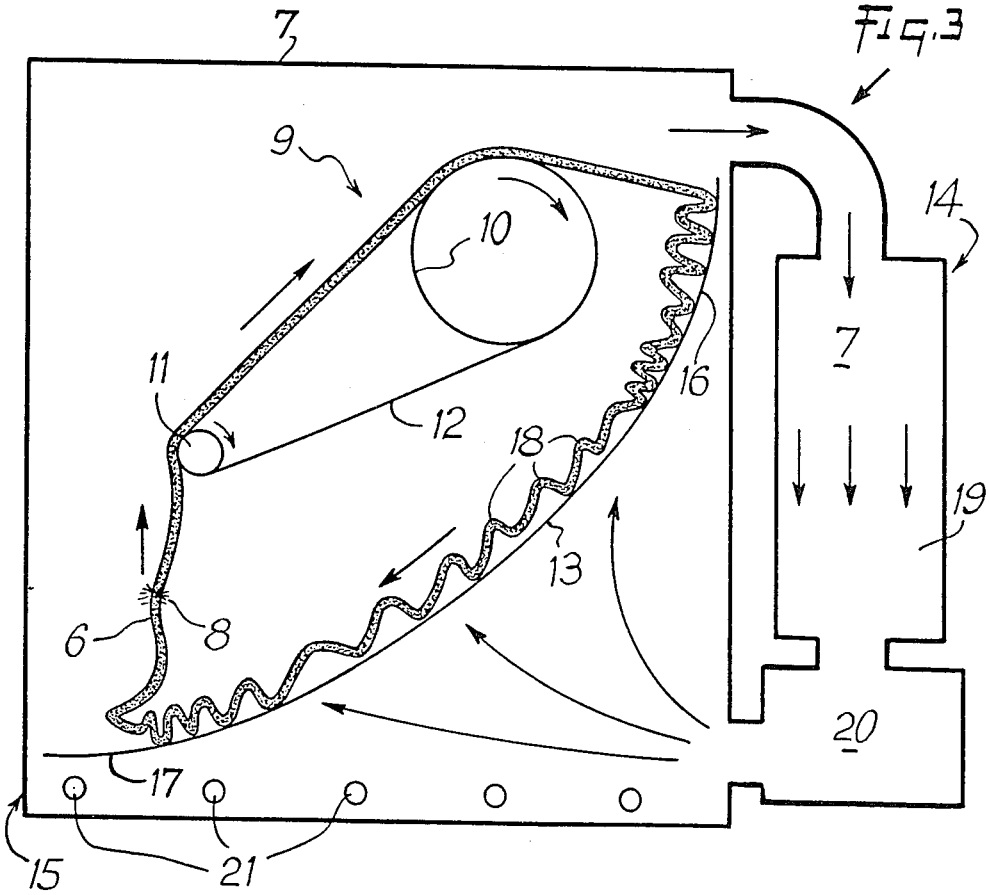
FIG. 3 is a longitudinal section of the device especially designed to carry out the method according to the invention.

The method and device according to the invention are designed to give a relaxed form, with stitches such as illustrated in FIG. 2, to a knitting whose stitches are deformed such as illustrated in FIG. 1. To obtain this result, the method and device according to the invention calls on the factors which are known to be essential to relaxation, namely humidity, heat and vibration of the knitting, in conditions such that the yarns and the stitches of the knitting move one with respect to the other to reach a balanced form wherein the knitting shows a minimum of internal stresses.

According to a preferred embodiment of the invention, the knitted fabric 6 is in closed loop form. To obtain this, it suffices after introducing a length of fabric in the treatment apparatus 7 and after advancing it through the different stages of the treatment, to assembly by way of a seam 8 the two ends of the length of fabric.

The treatment apparatus 7 comprises a movable element of projection 9, a rigid element 13 and means 14 and 15, respectively, for circulating hot air and saturating steam.

The movable element of projection 9 is constituted by a driving cylinder 10 capable of high speed rotation, reaching 600 meters per minute of peripheral speed, by a deviating cylinder 11, mounted idle on its rotation axis, and by a conveyor belt 12 turning over the driving cylinder 10 and the deviating cylinder 11.

The conveyor belt comprises a surface which is sufficiently rough for the knitted fabric to be carried without slipping.

The rigid element 13 is constituted by a sheet metal plate of smooth and incurved surface. Said plate is placed under the conveyor belt; one of its ends 16 is situated level with the driving cylinder 10 and faces it, the other end 17 being situated beyond the deviating cylinder 11. Thus the knitted fabric coming from the conveyor belt is projected against the said plate at the level of the end 16, piles up on said plate 13 into successive folds 18 sliding gradually towards the end 17, wherefrom the fabric is driven towards the conveyor belt 12 perpendicularly to the deviating cylinder 11.

The movable element 9 and the rigid element 13 are so positioned one with respect to the other as to optimize the relaxing treatment. On the one hand, the upper end 16 of the plate 13 is situated at a distance from the driving cylinder 10 so as to project the fabric exactly onto said plate—this being easily determined by experiment—and so that the fabric can pile up into folds on said plate. The length of the fabric between the place where it comes off the driving cylinder and the place where it contacts with the plate is, according to a practical application, around 600 millimeters.

On the other hand, the lower end 17 of the plate 13 is situated at a distance from the deviating cylinder 11 such that the tension created by the conveyor belt pulling the fabric is as low as possible. The length of the fabric between its piling up on the plate 13 and the contact with the conveyor belt is, according to a practical application, around 800 millimeters.

Figure 4:
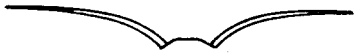
FIG. 4 is a partial longitudinal section of the rigid element across one of its perforations.

The sheet metal plate 13 is perforated to allow the hot air or saturating steam to flow through the knitted fabric. Said perforations are designed so that the fabric does not catch on to the plate; therefore they are either stamped in or punched in as illustrated in FIG. 4.

The treatment apparatus 7 comprises known means for producing and circulating hot air; said air is heated in the exchanger 19 and propelled by the turbine 20 in order to be sent into the lower part of the treatment chamber proper. The hot air goes up through the perforations of the plate and/or on the sides thereof, and comes into contact with the fabric while the latter is moving on the conveyor belt and on the plate. After that, the air which has cooled slightly and which has picked up some humidity if the fabric was humid, is directed towards the exchanger 19. Said air is therefore recycled throughout the treatment.

The treatment apparatus 7 comprises known means for producing and circulating saturating steam. These can be, for example, spraying ramps 21, supplied with steam from a steam generator, not shown.

In the following examples, the installation used has the following characteristics:

- diameter of the driving cylinder: 560 millimeters;
- diameter of the deviating cylinder: 90 millimeters;
- distances of the line of projection of the fabric onto the plate:
  - 500 millimeters from the vertical plane traversing the axis of the driving cylinder;
  - 540 millimeters from the horizontal plane traversing the axis of the driving cylinder;
- distance from the plate to the axis of the deviating cylinder measured in the vertical plane traversing said axis: 840 millimeters;
- peripheral speed of the driving cylinder: 120 meters per minute;
- conveyor belt constituted by an assembly consisting of a cotton sheet and a Jacquard knitting in polyester, both of which are assembled by means of a polyurethane foam, according to the technique known as "foaming";
- hot air temperature at the inlet to the treatment chamber: 75° C.

EXAMPLE 1

In an installation such as described hereinabove, is treated a flannel-type knitted fabric, weighing 327 grams per square meter, said fabric being produced from the three following constituents:

- a texturized polyamide foundation yarn of 81.9×2 decitex, each one of the two strands comprising 17 filaments. The length of absorbed yarn for one hundred stitches is 44.6 centimeters.
- a looping yarn in texturized polyamide (81.3×1 decitex) comprising 17 filaments. The length of absorbed yarn per one hundred stitches is 43.2 centimeters.
- a flannel-type texturized cotton yarn (48.4×1 tex). The length of absorbed yarn per one hundred stitches is 17.4 centimeters.

Prior to the relaxing treatment, the knitted fabric is bleached, vat-softened then spun-dried. It is introduced in a humid state in the installation, i.e. with a residual humidity content of about 40% with respect to its dry weight.

The flannel-like knitted fabric is treated with the method according to the invention for 45 minutes. A length of this fabric is treated, the flannel side being on the inside of the length which, since it has been knitted on a circular knitting machine is tubular shaped; the percent potential shrinkages obtained are 4.4% in wale direction and −0.7% in course direction. Another length of the same fabric is treated, the flannel side being on the outside of the tubular length; the percent potential shrinkages are 2.9% in wale direction and −1.9% in course direction.

This difference is easily explained due to the fact that in the second case, the flannel yarns come into direct contact with the rigid plate when the fabric is projected onto said plate: the energy supplied comes into opposition against the friction forces of the said flannel yarn, which as a result can slide more easily one over the other.

Potential shrinkages or extensions are measured on a laboratory relaxing machine, in operational conditions such that the dimensions obtained are representative of an optimum relaxation.

The average thickness is measured on the flannel-knit fabric before and after the relaxing treatment, to determine the increase in bulkiness. Said measurements are taken with an automatic apparatus under different pressures. Under a pressure of 1 gram per square centimeter the thickness measured is 2.27 before treatment and 2.38 after treatment under a pressure of 10 grams per square centimeter, the thickness is 1.92 before and 2.02 after the relaxing treatment. The increase in bulkiness is around 5%.

EXAMPLE 2

The same flannel-knit fabric is subjected to a napping treatment before being introduced, dry, into the relaxing installation where it is treated first in the presence of saturating steam for 10 minutes and then with hot air at 75° C. for 10 minutes.

The percent potential shrinkages obtained are 5% in wale direction and 0.5% in course direction.

EXAMPLE 3

A looped knitting weighing 288 grams per square meter is treated in the installation, said knitting being made from two constituents as follows:

- a foundation yarn of texturized polyamide (82.5×1 decitex) comprising 17 filaments. The length of absorbed yarn per one hundred stitches is 35.7 centimeters;
- a looped yarn in cotton (16.4×1 tex). The length of absorbed yarn per one hundred stitches is 75 centimeters.

The fabric coming out of the knitting machine is bleached, vat-softened and spun-dried. It is then introduced into the installation in a humid state, i.e. with a residual humidity content of about 40% with respect to its dry weight.

Said looped fabric is treated with the method according to the invention for 45 minutes. A length of this fabric is treated, the looped side being on the inside of the fabric which is tubular shaped. The percent potential shrinkages are 4.8% in wale direction and 3.1% in course direction. Another length of the same fabric is treated, with the looped side on the outside of the tubular length; the percent potential shrinkages are 4.5% in wale direction and −1.8% in course direction.

As in the case of the flannel-knit fabric, the loops presented on the outside of the fabric, give better results.

Thickness measurements, under a pressure of 1 gram per square centimeter, are 1.63 for the looped knitting before treatment and 2.47 after treatment. Under 10 grams per square centimeter these measurements are 1.36 before and 2.13 after treatment. The increase in bulkiness is more than 50%.

EXAMPLE 4

The same looped knitting as that used in the preceding example has undergone a shearing treatment before being introduced, dry, into the relaxing installation where it is treated first in the presence of saturating steam for 10 minutes, then with hot air at 75° C. for another 10 minutes. The percent potential shrinkages obtained are 5.4% in wale direction and −2.7% in course direction.

EXAMPLE 5

Lastly, comparative tests were made between the different existing relaxation materials, with a length of 1K-1P ribbing, which was first subjected to a wetting treatment and then to a spin-drying, in the same conditions. The results of potential shrinkages obtained after the relaxing treatment have confirmed the efficiency of the method according to the invention over the known techniques, as far as dimensional stability is concerned.

Figure 5:
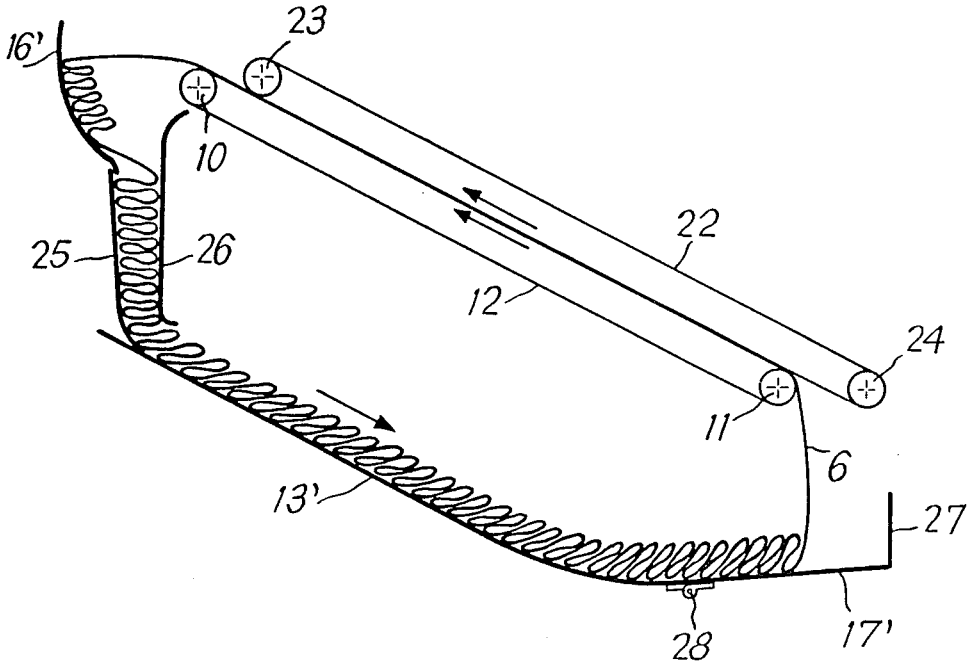
FIG. 5 is a longitudinal section of a second embodiment of the device according to the invention.

FIG. 5 illustrates a second embodiment of the device according to the invention wherein the knitting 6 is driven by the conveyor belt 12 which rotates about rollers 10 and 11. A second belt 22 rotating over rollers 23,24 can be superposed to the first belt 12 in order to improve the advancing movement of the fabric, without slipping and deformations. As an alternative, a pressing roller cooperating with the belt 12 can also be provided.

According to this particular embodiment, the rigid element 13' is constituted by a plurality of sub-assemblies: the upper end is constituted by a receiving front piece 16' against which is projected the fabric.

Beneath said front piece 16', a transition element 25 forms, together with a guide 26 facing it, a shaft inside of which the knitting falling off the front piece by its own weight, can pile up in more or less great quantity so that it pushes downwards the knitting piled up on the inclined plane forming the central part of the rigid element 13'.

At the end of the inclined plane is a low point with next to it a plate which is optionally flat or curved, which plate ends into a virtually vertical element 27 preventing the knitting from sliding out of the system.

By actuating the plate 17' upwards or downwards, it is possible to brake the movement of the knitting arriving at the bottom of the inclined plane, and thus to balance the action of the shaft 25-26, of the inclined plane, and of the plate 17'.

To adjust the plate 17' it is possible to alter its flexibility or preferably to provide, at 28, a pivoting connection to this effect.

What we claim is:

1. Apparatus for relaxing knitted fabric including in combination, means comprising a conveyor belt for advancing said fabric toward an outlet zone, a rigid stationary support providing a fabric receiving surface and an accumulation surface, said fabric receiving surface extending substantially vertically and being positioned adjacent said outlet zone and said accumulation surface being generally positioned below said belt, driving means comprising a pair of rollers supporting said belt for driving said belt at a high speed over about 120 meters per minute forcibly to project said fabric from said outlet zone substantially perpendicularly onto said receiving surface to cause said fabric to pile up in untensioned condition on said accumulation surface, and means for heating said fabric.

2. Apparatus as in claim 1 in which said speed is about 600 meters per minute.

3. Apparatus as in claim 1 in which said rigid support is perforated to permit the passage therethrough of a heating medium.

4. Apparatus as in claim 1 in which said heating means comprises a heat exchanger supplying hot air and a turbine for propelling the hot air toward the fabric.

5. Apparatus as in claim 1 in which said heating means comprises steam spraying means.

6. Apparatus as in claim 1 including means for adjusting the inclination of the lower end of the rigid support.

7. Method for relaxing knitted fabrics by the use of humidity, heat and agitation, said agitation comprising the steps of advancing said fabric on a conveyor belt toward an outlet zone at a high speed over about 120 meters per minute and forcibly projecting said advancing fabric from said outlet zone substantially perpendicularly onto a fabric receiving surface provided on a rigid stationary support, said fabric receiving surface extending substantially vertically and being positioned adjacent said outlet zone, said agitation being followed by a piling up of said fabric in untensioned condition on an accumulation surface provided on said support and being positioned below said belt.

8. A method as in claim 7 in which said fabric is in closed loop form.

9. A method as in claim 7 in which said advancing step comprises driving said fabric by friction without slipping into an outlet zone and in which said projecting step comprises projecting said fabric from said outlet zone against a receiving zone of the support, said receiving zone being close to said outlet zone and extending substantially transversely to the direction of projection.

* * * * *